US011337516B1

(12) United States Patent
You et al.

(10) Patent No.: US 11,337,516 B1
(45) Date of Patent: May 24, 2022

(54) HEIGHT ADJUSTABLE WORKSTATION

(71) Applicant: Xiaodong You, Zhejiang (CN)

(72) Inventors: Xiaodong You, Zhejiang (CN); Gaobo Lin, Zhejiang (CN)

(73) Assignee: Xiaodong You, Zhejiang (CN)

( * ) Notice: Subject to any disclaimer, the term of this patent is extended or adjusted under 35 U.S.C. 154(b) by 0 days.

(21) Appl. No.: 17/396,870

(22) Filed: Aug. 9, 2021

(30) Foreign Application Priority Data

Jun. 3, 2021 (CN) ..... 202121232329.2

(51) Int. Cl.
*A47B 21/02* (2006.01)
*A47B 21/06* (2006.01)
*A47B 9/16* (2006.01)

(52) U.S. Cl.
CPC ..... *A47B 21/02* (2013.01); *A47B 9/16* (2013.01); *A47B 21/06* (2013.01)

(58) Field of Classification Search
CPC . B66F 7/065; B66F 3/22; A47B 21/02; A47B 9/16; A47B 2021/035
USPC ..... 108/50.02, 50.01, 145; 254/122
See application file for complete search history.

(56) References Cited

U.S. PATENT DOCUMENTS 4,558,648 A * 12/1985 Franklin ..... B66F 7/065 108/136
5,588,377 A * 12/1996 Fahmian ..... A47B 9/00 108/145
9,504,316 B1 * 11/2016 Streicher ..... A47B 21/02
9,999,489 B1 * 6/2018 Kern, Sr. ..... B66F 7/08
10,028,576 B1 * 7/2018 Yao ..... A47B 21/06
10,264,877 B2 * 4/2019 Hu ..... A47B 9/16
10,869,549 B2 12/2020 Xiang et al.
10,893,748 B1 * 1/2021 Poniatowski ..... A47B 21/06
2003/0150657 A1 * 8/2003 Shupp ..... B66F 7/0625 180/168
2003/0189194 A1 * 10/2003 Latvys ..... B66F 7/08 254/9 C
2009/0078509 A1 * 3/2009 Olsen ..... B66F 7/065 187/211
2011/0240409 A1 * 10/2011 Bacon ..... B66F 7/065 187/269

(Continued)

FOREIGN PATENT DOCUMENTS

CN 212165254 12/2020

*Primary Examiner* — Jose V Chen
(74) *Attorney, Agent, or Firm* — Mark E. Bandy; Rankin Hill & Clark, LLP

(57) ABSTRACT

An embodiment of the present application provides a height adjustable workstation, comprising: a base; a supporting rod assembly comprising a first supporting rod and a second supporting rod, wherein a middle of the first supporting rod is hinged to a middle of the second supporting rod, a bottom end of the first supporting rod is hinged to the base, and a bottom end of the second supporting rod is slidably and rotatably connected to the base; a tabletop, to which a top end of the first supporting rod is slidably and rotatably connected and to which a top end of the second supporting rod is hinged; a telescopic mechanism, one end of which is hinged to the first supporting rod and the other end of which is hinged to the second supporting rod. The extension or contraction of the stroke of the telescopic mechanism controls synchronous movement between the supporting rods, and the supporting rods control the lifting and lowering of the tabletop.

8 Claims, 3 Drawing Sheets

(56) References Cited

U.S. PATENT DOCUMENTS

| | | | | |
|---|---|---|---|---|
| 2015/0289641 | A1* | 10/2015 | Ergun | A47B 9/18 108/42 |
| 2017/0295923 | A1* | 10/2017 | Liu | A47C 7/68 |
| 2017/0354245 | A1* | 12/2017 | Martin | A47B 21/02 |
| 2018/0055214 | A1* | 3/2018 | Kim | A47B 9/02 |
| 2018/0118538 | A1* | 5/2018 | Latvys | B66F 7/08 |
| 2018/0125227 | A1* | 5/2018 | Xiang | A47B 21/02 |
| 2018/0140089 | A1* | 5/2018 | Blackburn | A47B 21/0314 |
| 2018/0146775 | A1* | 5/2018 | You | A47B 9/16 |
| 2018/0184797 | A1* | 7/2018 | Chuang | A47B 9/16 |
| 2018/0192769 | A1* | 7/2018 | Xiang | A47B 21/0314 |
| 2018/0279770 | A1* | 10/2018 | Crowe | A47B 21/02 |
| 2020/0029683 | A1* | 1/2020 | Xiang | A47B 9/16 |
| 2020/0107633 | A1* | 4/2020 | Kang | A47B 21/02 |

* cited by examiner

HEIGHT ADJUSTABLE WORKSTATION

TECHNICAL FIELD

This application relates to the field of office furniture, in particular to a height adjustable workstation.

BACKGROUND

At present, the commonly used office computer desks can only be used for sitting position and have a fixed height. It can be not guaranteed to provide a suitable computer display height for computer users because of their physical differences. Diseases such as cervical spine diseases will be caused if users work at uncomfortable heights for a long time. For health needs of users, vertically adjustable height adjustable workstations are gradually applied in the office field. However, the adjustment of the current height adjustable workstation is complex and cumbersome, and the height of the workstation cannot be arbitrarily adjusted.

SUMMARY

The purpose of embodiments of the present application is to provide a height adjustable workstation, which is laborsaving in the adjustment process, and the height of the workstation can be arbitrarily adjusted. The specific technical solutions are as follows.

An embodiment of the present application provides a height adjustable workstation, comprising: a base; a supporting rod assembly comprising a first supporting rod and a second supporting rod, wherein a middle of the first supporting rod is hinged to a middle of the second supporting rod, a bottom end of the first supporting rod is hinged to the base, and a bottom of the second supporting rod is slidably and rotatably connected to the base; a tabletop, to which a top end of the first supporting rod is slidably and rotatably connected and to which a top end of the second supporting rod is hinged; a telescopic mechanism, one end of which is hinged to the first supporting rod and the other end of which is hinged to the second supporting rod.

In the height adjustable workstation according to the embodiment of the present disclosure, when the telescopic mechanism is extended, the top end of the first supporting rod slides inwards in a length direction of the tabletop, the bottom end of the first supporting rod is hinged to the base, and the first supporting rod rotates clockwise around the pin shaft. The bottom end of the second supporting rod slides inwards in the length direction of the base, the top end of the second supporting rod is hinged to the tabletop, and the second supporting rod rotates counterclockwise around the pin shaft, and the tabletop is lifted under the drive of the supporting rod assembly. When the telescopic mechanism is contracted, the top end of the first supporting rod slides outwards in the length direction of the tabletop, and the bottom end of the first supporting rod is hinged to the base, the first supporting rod rotates counterclockwise around the pin shaft. The bottom end of the second supporting rod slides outwards in the length direction of the base, and the top end of the second supporting rod is hinged to the tabletop, the second supporting rod rotates clockwise around the pin shaft, and the tabletop is lowered under the drive of the supporting rod assembly. The operation process is simple and laborsaving due to the assistance of the telescopic mechanism. The height of the tabletop is fixed when the telescopic mechanism is locked, so as to ensure that the height of the tabletop is freely adjustable.

In addition, a height adjustable workstation according to an embodiment of the present application can also have additional technical features as follows.

In some embodiments of the present application, the base comprises a rectangular frame on which a first slide rail groove extending in a length direction is provided, and the bottom end of the second supporting rod is slidably and rotatably limited in the first slide rail groove.

In some embodiments of the present application, there are one or two supporting rod assemblies.

In some embodiments of the present application, a second slide rail groove is provided in a bottom surface of the tabletop, and the top end of the first supporting rod is slidably and rotatably limited in the second slide rail groove.

In some embodiments of the present application, an elongated groove is provided in a top surface of the workstation for accommodating an object.

In some embodiments of the present application, a threading hole is provided at a bottom of the elongated groove, and a wire harness buckle is provided on a bottom surface of the tabletop.

In some embodiments of the present application, the height adjustable workstation further comprises a keyboard plate, which is connected to the bottom surface of the tabletop through a bracket with a weight-reducing through hole and protrudes from a long side of the rectangular frame.

In some embodiments of the present application, a first connecting rod is provided at the bottom of the second supporting rod, and a first roller bearing is provided at an end of the first connecting rod and is limited in the first slide rail groove.

In some embodiments of the present application, a second connecting rod is provided at the top end of the first supporting rod, and a second roller bearing is provided at an end of the second connecting rod and is limited in the second slide rail groove.

BRIEF DESCRIPTION OF THE DRAWINGS

In order to more clearly describe the technical solutions in the embodiments of the present application or the prior art, the drawings that need to be used in the description of the embodiments or the prior art will be introduced briefly in the following. Obviously, the drawings in the following description are merely some embodiments of the present application, and other embodiments can be obtained by those skilled in the art based on these drawings.

DETAILED DESCRIPTION

The technical solutions in the embodiments of the present application will be clearly and completely described below in conjunction with the drawings in the embodiments of the present application. Obviously, the described embodiments are only some embodiments of the present application, rather than all the embodiments.

Based on the embodiments in this application, all other embodiments obtained by those ordinary skills in the art based on this application fall within the protection scope of this application.

Figure 1:
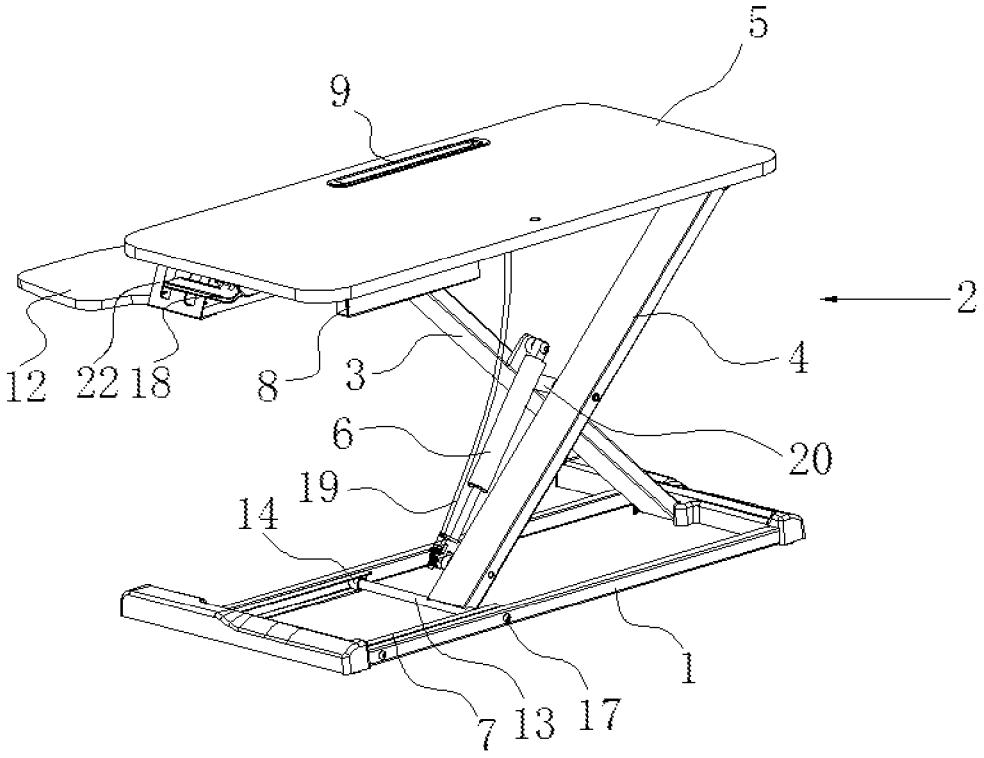
FIG. 1 is a schematic structural diagram of a height adjustable workstation according to an embodiment of the application.
Figure 2:
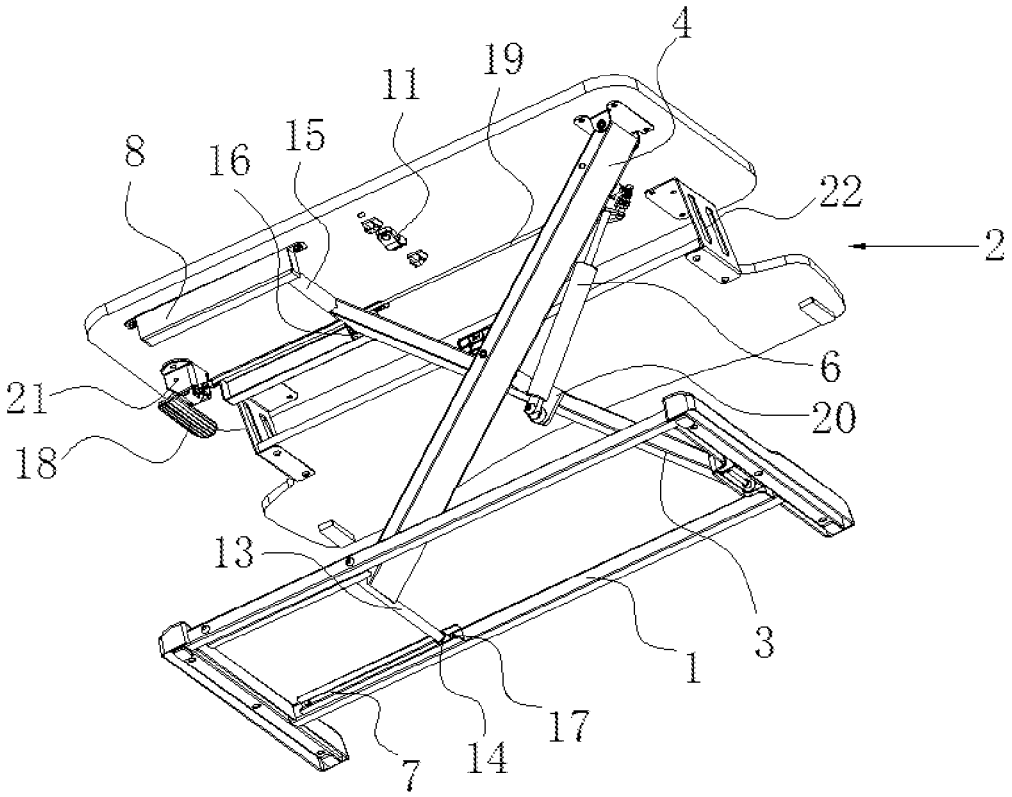
FIG. 2 is a schematic structural diagram of the height adjustable workstation according to an embodiment of the application when viewed from another perspective.

As shown in FIGS. 1 to 2, an embodiment of the present application provides a height adjustable workstation, comprising a base 1, a supporting rod assembly 2, a tabletop 5, and a telescopic mechanism 6. Specifically, the supporting rod assembly 2 comprises a first supporting rod 3 and a second supporting rod 4, and the middle of the first supporting rod 3 is hinged to the middle of the second supporting rod 4 by a pin shaft 20. The bottom end of the first supporting rod 3 is hinged to the base 1, and the top end of the first supporting rod 3 is slidably and rotatably connected to the tabletop 5. The bottom end of the second supporting rod 4 is slidably and rotatably connected to the base 1, and the top end of the second supporting rod 4 is hinged to the tabletop 5. One end of the telescopic mechanism 6 is hinged to the first supporting rod 3, and the other end of the telescopic mechanism 6 is hinged to the second supporting rod 4.

In the height adjustable workstation according to the embodiment of the present application, when the telescopic mechanism 6 is extended, the top end of the first supporting rod 3 slides inwards in a length direction of the tabletop 5, the bottom end of the first supporting rod 3 is hinged to the base 1, and the first supporting rod 3 rotates clockwise around the pin shaft 20. The bottom end of the second supporting rod 4 slides inwards in the length direction of the base 1, the top end of the second supporting rod 4 is hinged to the tabletop 5, the second supporting rod 4 rotates counterclockwise around the pin shaft 20, and the tabletop 5 is lifted under the drive of the supporting rod assembly 2. When the telescopic mechanism 6 is contracted, the top end of the first supporting rod 3 slides outwards in the length direction of the tabletop 5, the bottom end of the first supporting rod 3 is hinged to the base 1, and the first supporting rod 3 rotates counterclockwise around the pin shaft 20. The bottom end of the second supporting rod 4 slides outwards in the length direction of the base 1, and the top end of the second supporting rod 4 is hinged to the tabletop 5, and the second supporting rod 4 rotates clockwise around the pin shaft 20, and the tabletop 5 is lowered under the drive of the supporting rod assembly 2. The operation process is simple and laborsaving due to the assistance of the telescopic mechanism 6. The height of the tabletop 5 is fixed when the telescopic mechanism 6 is locked, so as to ensure that the height of the tabletop 5 is freely adjustable.

In some embodiments of the present application, the telescopic mechanism 6 can be a gas spring or an electric push rod, or other devices capable of providing telescopic movement.

In some embodiments of the present application, the telescopic mechanism 6 is a rigid self-locking gas spring, an end of a piston rod of which is provided with an actuating switch. The actuating switch can control the rigid self-locking gas spring to be locked at any position of its stroke or release the lock on the rigid self-locking gas spring. The height adjustable workstation in this embodiment further comprises a cable 19 and a handle 18. One end of the cable 19 is tied to the handle 18, and the other end is tied to the actuating switch of the telescopic mechanism 6. When applying an upward or downward force to the tabletop 5 and pressing the handle 18 at the same time, the handle 18 rotates around its inner rotating shaft 21, and the cable 19 is pulled to move with it. Since the length of the cable 19 is fixed and not telescopic, the cable 19 pulls the actuating switch of the telescopic mechanism 6 under the traction of the rotation of the handle 18 so that the telescopic mechanism 6 is extended or contracted, and the height of the tabletop 5 is raised or lowered. When the handle 18 is released, the handle 18 is reset under the action of an internal spring, and the cable 19 loses traction, and the actuating switch of the telescopic mechanism 6 is reset and locked at the same time under the action of the internal spring, and the height of the workstation 5 is fixed. As a result, the problem that the adjustment process is time-consuming and labor-intensive can be solved, and the height of the workstation can be arbitrarily adjusted.

In some embodiments of the present application, a first connecting rod 13 is provided at the bottom of the second supporting rod 4, and the two are not limited to being fixedly connected by welding. Both ends of the first connecting rod 13 are slidably arranged in a first slide rail groove 7. Moreover, the first connecting rod 13 can rotate relative to the first slide rail groove 7.

In some embodiments of the present application, a first roller bearing 14 is provided at an end of the first connecting rod 13, and is limited in the first slide rail groove 7. When the telescopic mechanism 6 is extended or contracted, the second supporting rod 4 acts on the first roller bearing 14 through the first connecting rod 13, so that the second supporting rod 4 can slide and rotate in the first slide rail groove 7.

In some embodiments of the present application, the top end of the first supporting rod 3 is provided with a second connecting rod 15, and the two are not limited to being fixedly connected by welding. Both ends of the second connecting rod 15 are slidably arranged in a second slide rail groove 8. Moreover, the second connecting rod 15 can rotate relative to the second slide rail groove 8.

In some embodiments of the present application, a second roller bearing 16 is provided at an end of the second connecting rod 15, and is limited in the second slide rail groove 8. When the telescopic mechanism 6 is extended or contracted, the first supporting rod 3 acts on the second roller bearing 16 through the second connecting rod 15, so that the first supporting rod 3 can slide and rotate in the second slide rail groove 8.

In some embodiments of the present application, the base 1 comprises a rectangular frame on which a first slide rail groove 7 extending in the length direction is provided, and both ends of the first slide rail groove 7 are provided with stop bolts 17 to prevent the first roller bearing 14 from slipping out during movement. The second roller bearing 16 is restricted from sliding out due to the structure at both ends of the second slide rail groove 8, and it is possible not to provide the stop bolts 17. The second slide rail groove 8 can adopt the open structure at both ends of the first slide rail groove 7 without the need of providing stop bolts 17 at both ends. Similarly, the first slide rail groove 7 can adopt the closed structure at both ends of the second slide rail groove 8 with the need of providing stop bolts 17 at both ends. It can be understood that the length direction of the rectangular frame refers to a direction parallel to the long sides of the rectangular frame.

In some embodiments of the present application, an elongated groove 9 is provided in the top surface of the tabletop 5 for accommodating an object. When placing a mobile phone or ipad, power harness may pass through a threading hole 10 at the bottom end of the elongated groove 9. At the same time, the bottom surface of the tabletop 5 is also provided with a wire harness buckle 11, which can be used to place the wire harness to avoid entanglement. A keyboard plate is connected to a bottom surface of the tabletop through a bracket with a weight-reducing through hole and protrudes from the long side of the rectangular frame.

In some embodiments of the present application, the bottom surface of the tabletop 5 is connected to the keyboard plate 12 through a bracket 22 with weight-reducing through holes, and the keyboard can be placed on the keyboard plate 12 for office use. Due to the existence of the keyboard in actual use, the center of gravity of the lifting mechanism is nearer the front, so the short side of the rectangular frame of the base 1 protrudes from the long side to ensure the stability of the lifting mechanism.

Figure 3:
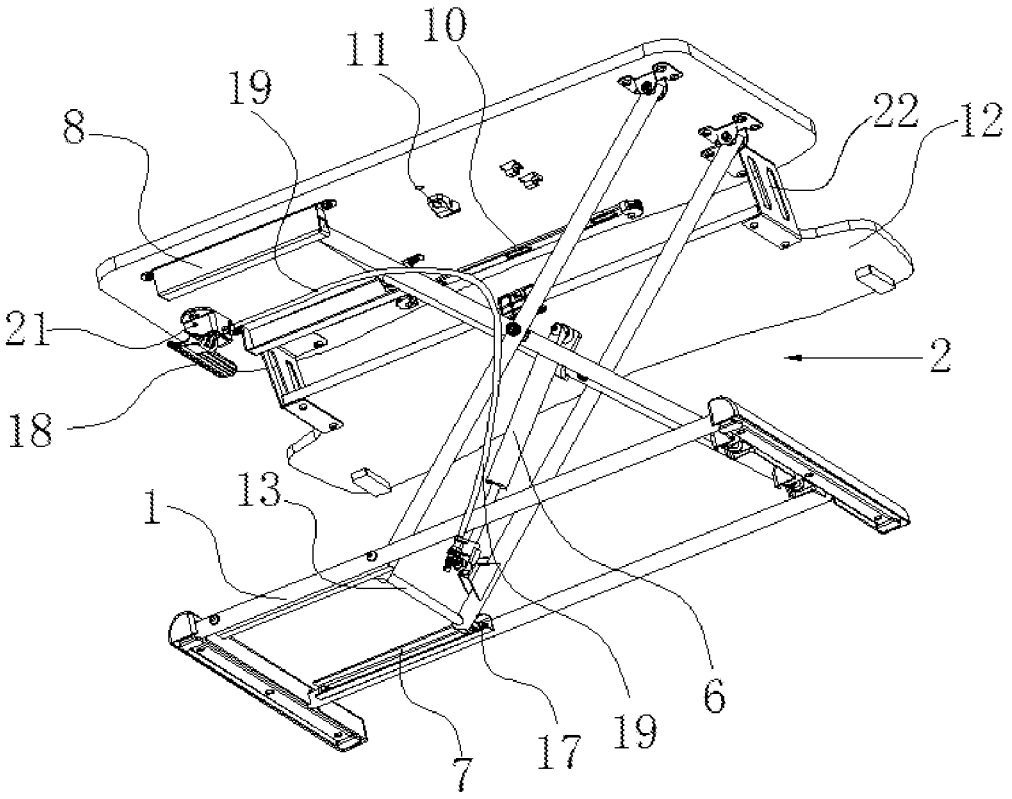
FIG. 3 is a schematic structural diagram of another height adjustable workstation according to an embodiment of the application.

In some embodiments of the present application, the number of supporting rod assembly 2 can be one (as shown in FIG. 2) or two (as shown in FIG. 3).

It should be noted that, in this document, relational terms, such as first and second and the like, are merely used to distinguish one entity or operation from another entity or operation, and do not necessarily require or imply any such actual relationship or order between these entities or operations. Moreover, the terms "comprise", "include" or any other variants thereof are intended to cover a non-exclusive inclusion, so that a process, method, article or device comprising a series of elements not only comprises those elements, but also comprises other elements that are not explicitly listed, or also comprises elements inherent to this process, method, article or device. Without further limitation, an element defined by the phrase "comprising a . . . " does not exclude the presence of other identical elements in the process, method, article, or device that comprises the element.

Various embodiments of the present application are described in a related manner, and the same or similar parts among the various embodiments can be referred to each other, and each embodiment focuses on the difference from other embodiments.

The foregoing description are only preferred embodiments of the present application, and are not used to limit the protection scope of the present application. Any modification, equivalent replacement, improvement, etc. made within the spirit and principle of this application should be included in the protection scope of this application.

What is claimed is:

1. A height adjustable workstation, comprising:

a base;

a supporting rod assembly comprising a first supporting rod and a second supporting rod, wherein a middle of the first supporting rod is hinged to a middle of the second supporting rod by a pin shaft, a bottom end of the first supporting rod is hinged to the base, and a bottom of the second supporting rod is slidably and rotatably connected to the base;

a tabletop, to which a top end of the first supporting rod is slidably and rotatably connected and to which a top end of the second supporting rod is hinged;

a telescopic mechanism, one end of which is hinged to the first supporting rod and the other end of which is hinged to the second supporting rod;

wherein an elongated groove is provided in a top surface of the workstation for accommodating an object, and wherein a threading hole that penetrates the tabletop to enable a wire harness to pass through the tabletop is provided at a bottom of the elongated groove, and a wire harness buckle for clamping the wire harness is provided on a bottom surface of the tabletop.

2. The height adjustable workstation according to claim 1, wherein the base comprises a rectangular frame on which a first slide rail groove extending in a length direction is provided, and the bottom end of the second supporting rod is slidably and rotatably limited in the first slide rail groove.

3. The height adjustable workstation according to claim 2, wherein the height adjustable workstation further comprises a keyboard plate which is connected to a bottom surface of the tabletop through a bracket with a weight-reducing through hole and protrudes from a long side of the tabletop.

4. The height adjustable workstation according to claim 3, wherein the rectangular frame comprises two long sides and two short sides, and the short sides of the rectangular frame protrude from long sides of the rectangular frame at a side where the keyboard plate is located.

5. The height adjustable workstation according to claim 2, wherein a first connecting rod is provided at a bottom of the second supporting rod, and a first roller bearing is provided at an end of the first connecting rod and is limited in the first slide rail groove.

6. The height adjustable workstation according to claim 1, wherein there are one or two supporting rod assemblies.

7. The height adjustable workstation according to claim 1, wherein a second slide rail groove is provided in a bottom surface of the tabletop, and the top end of the first supporting rod is slidably and rotatably limited in the second slide rail groove.

8. The height adjustable workstation according to claim 7, wherein a second connecting rod is provided at the top end of the first supporting rod, and a second roller bearing is provided at an end of the second connecting rod and is limited in the second slide rail groove.

* * * * *